United States Patent [19]

Unks

[11] 4,427,371

[45] Jan. 24, 1984

[54] PUSHER FURNACE WITH SOAK ZONE LIFTER

[75] Inventor: Howard N. Unks, Glenshaw, Pa.

[73] Assignee: Loftus Furnace Company, Pittsburgh, Pa.

[21] Appl. No.: 341,042

[22] Filed: Jan. 20, 1982

[51] Int. Cl.[3] ..... F27D 3/00; F27D 3/04; F27B 9/14

[52] U.S. Cl. ..... 432/11; 432/122; 432/127

[58] Field of Search ..... 432/11, 122, 239, 127

[56] References Cited

U.S. PATENT DOCUMENTS

| | | | |
|---|---|---|---|
| 599,146 | 2/1898 | Laughlin et al. | 432/127 |
| 897,746 | 9/1908 | Johnson | 432/127 |
| 938,424 | 10/1909 | Johnson | 432/234 |
| 1,380,102 | 5/1921 | Horn | 432/127 |
| 2,214,234 | 9/1940 | Meyer | 432/234 |
| 3,179,390 | 6/1962 | Boutigny et al. | 432/10 |
| 3,345,050 | 10/1967 | Guthrie | 432/234 |
| 3,450,394 | 1/1967 | Wilde et al. | 432/49 |
| 3,540,706 | 11/1970 | Wilt, Jr. | 432/124 |
| 3,554,505 | 1/1971 | Dessarts | 432/122 |
| 3,599,944 | 8/1971 | Erixson et al. | 432/124 |
| 3,712,596 | 1/1973 | Cope et al. | 432/11 |
| 3,716,222 | 2/1973 | Anderson | 432/133 |
| 3,820,946 | 6/1974 | Miyoshi et al. | 432/239 |
| 3,951,583 | 4/1976 | Carretta et al. | 432/124 |

FOREIGN PATENT DOCUMENTS

| | | | |
|---|---|---|---|
| 1205450 | 2/1960 | France | 432/121 |

*Primary Examiner*—John J. Camby

*Attorney, Agent, or Firm*—Herbert E. Messenger

[57] ABSTRACT

A pusher-type furnace for heating slabs is disclosed having lift rails in its soak zone for periodically raising slabs out of contact with skid rails along which the slabs travel through the furnace. The controlled raising and lowering of the lift rails in the soak zone alternates with extraction of slabs from the furnace discharge end and pushing of slabs along the skid rails, and reduces or eliminates soak zone skid marks on the bottom surface of the slabs without the need for a soak hearth. The lift mechanism comprises an open structure of rails and supporting members to facilitate heating as well as soaking of the slabs in the furnace soak zone, thus promoting efficient use of fuel.

4 Claims, 8 Drawing Figures

PUSHER FURNACE WITH SOAK ZONE LIFTER

BACKGROUND OF THE INVENTION

This invention relates to metal treating furnaces, and particularly furnaces for reheating steel slabs.

Reheat furnaces presently in commerical use are typically either pusher furnaces or walking beam furnaces. In pusher furnaces slabs are loaded one at a time into the upstream end or preheat zone of a furnace and then pushed along longitudinal, water-cooled skid rails by the introduction of successive slabs into the furnace. The slabs eventually form an unbroken line along the length of the furnace. Because the portions of the bottoms of each slab in contact with the skid rails are not directly exposed to radiant heat and to hot gases from burners which fire into the furnace to heat the slabs and because they are also cooled by the skid rails, these bottom portions develop lower temerature regions known as skid marks or dark zones. To eliminate or minimze these skid marks, pusher type reheat furnaces include a soak zone prior to the furnace outlet. After the slabs travel through the preheat zone and a heat zone, they are pushed off the skid rails onto a soak hearth in the soak zone. Here the slabs "soak" in an essentially constant temperature environment for a time sufficient to eliminate or minimize the skid marks. The slabs are then unloaded from the reheat furnace and further processed, as in a rolling mill.

Although pusher-type reheat furnaces are widely used, their soak hearths present certain drawbacks. The hearths may, for example, be less effective than desired in removing skid marks. Also, the hearths require periodic maintenance such as removal of scale and refurbishing of the hearth surface. Moreover, the presence of a soak zone occupying up to one third of the furnace length may limit furnace production rate and fuel efficiency since it requires essentially all of the slab heating to be achieved in the zones upstream of the soak zone.

In walking beam furnaces, parts are transported along the entire furnace length by mechanisms which periodically lift one or more parts off supporting rails, translate the part through a horizontal step, lower the part back onto the rails, and retract to their initial position. Since bottom portions of the parts are in contact with the rails only part of the time during heating, skid marks do not form or are greatly reduced in walking beam furnaces, and soak hearths are usually not required. However, walking beam mechanisms for slab reheat furnaces are quite complex and expensive since they must be capable of transporting slabs weighing several tons and since such walking beams must extend over the entire length of the furnace. Such complexity is also a drawback of other known devices for eliminating skid marks such as mechanisms for turning slabs over within the furnace.

Accordingly, it is an object of this invention to provide a pusher-type reheat furnace with an improved soak zone.

It is an object of the invention to provide a reheat furnace with a soak zone which eliminates or reduces skid marks without the use of a soak hearth.

It is an object of the invention to provide a reheat furnace with a simple transport mechanism and which produces high heating efficiency.

SUMMARY OF THE INVENTION

An improved pusher-type reheat furnace and method for heating articles such as slabs therein are provided, the furnace having fixed longitudinal skid rails along its full length and a soak zone including lift rails to periodically lift slabs or other articles being heated out of contact with the skid rails. Lifting of the slabs allows more uniform heating of their bottom portions and thus reduces skid marks on the slabs. The lift rails eliminate the need of a soak hearth and its associated maintenance and permit heating of slabs along the full length of the furnace, thereby promoting high heating efficiencies and increased production.

During operation of the improved pusher-type reheat furnace parts are introduced into its preheat zone and pushed at a prescribed rate along the rails through the preheat and heat zones and into the soak zone. Hot gases from burners such as burners mounted in the walls and roof of the soak zone and the heat zone raise the temperature of the slabs as they progress through the furnace. Slabs entering the soak zone are pushed along the skid rails until they reach a position over lift rails mounted parallel to and preferably between two or more skid rails. Between pushes, the lift rails raise the slabs above the skid rails to permit more uniform heating of the bottom slab portions. The lift rails then lower the slabs back onto the skid rails for the next push along the soak zone. During steady-state operation the slabs form an unbroken line through the furnace and each push is preceded by removal of a slab from the outlet end of the soak zone by an extractor.

The lift mechanism and skid rail arrangement of the invention may be employed in new furnaces or in the retrofit of existing pusher furnaces to provide fuel savings and improve production. Retrofit applications are particularly desirable since in existing pusher furnaces only the soak zone requires significant modifications to achieve the improved furnace of the invention.

DETAILED DESCRIPTION OF PREFERRED EMBODIMENTS

Figure 1:
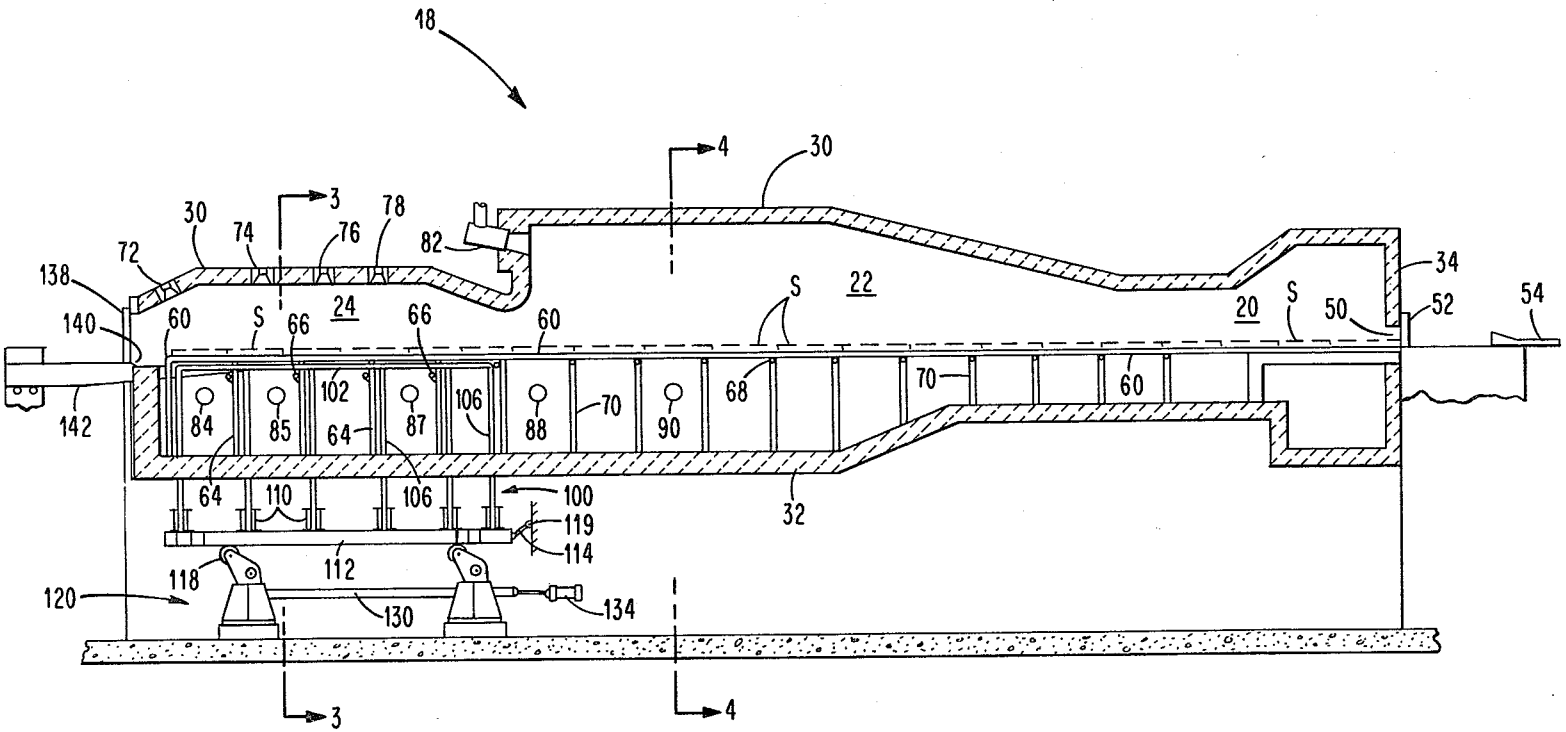
FIG. 1 is a simplified longitudinal sectional view of a reheat furnace according to the invention.

FIGS. 1–4 illustrate a preferred reheat furnace 18 according the invention which is designed to heat slabs S of steel or other generally flat parts as they are successively advanced through a preheat zone 20, a heat zone 22, and a soak zone 24. The zones 20, 22, and 24 or interior portions of the furnace 18 are defined by a roof structure 30, a hearth area 32, a charge endwall 34 and a discharge endwall, and side walls 38 and 40. In the charge endwall 34 there is provided a charging opening 50 through which slabs S may be loaded into the preheat zone 20, as by opening a charging door 52 and pushing the slabs in desired sequence by a pusher mechanism illustrated schematically at 54. Such pusher mechanisms are well known in the furnace art and therefore the pusher 54 is not further described herein.

Extending longitudinally from the charging opening 50 along essentially the entire length of the furnace 18 are one or more laterally spaced sets of fixed skid rails 60 for supporting the slabs S during their travel through the furnace 18. Although the furnace illustrated in FIGS. 1-4 is shown as having two pairs of skid rails 60, other combinations of rails may of course be desirable depending on furnace width, part size, and other factors.

The skid rails 60 may be of conventional construction — e.g., they may be formed of heavy steel pipe attached to water-cooled headers and may carry steel wearing bars on their top surface. Such constructions are, for example, described in U.S. Pat. No. 3,345,050, of common assignee with the present invention, and whose disclosure is incorporated herein by reference thereto. Structural support for the skid rails 60 is provided by a plurality of vertical support members 64, lateral support beams such as beams 66 and 68, and other members such as U-shaped supports 70.

Hot gases for heating the slabs S are provided by a system of burners mounted in the roof and walls of the furnace and arranged to fire hot combustion products into the heat zone 22 and the soak zone 24 from both above and below the slabs S. The burner system may include one or more liquid-or gas-fired burners mounted in the roof 30 such as the burners 72, 74, 76, and 78 arranged to direct hot combustion products into the top portion of the soak zone 24 and burners such as the burner 82 arranged to direct hot combustion products into the top portion of the heat zone 22. Additional burners are mounted in the portion of the side walls 38 and 40 below the skid rails 60—for example, burners 84, 85, 86, and 87 are oriented to direct hot combustion products into the lower portion of the soak zone 24, and burners 88 and 90 are oriented to direct hot combustion products into the lower portion of the heat zone 22. For the side wall 40, burners such as the burner 86 (FIG. 3) may be installed at locations along the furnace between those of the burners 85, 87, 88, and 90 so as to form an alternating array of burners; alternatively, at least some burners may be positioned at opposed locations. In the interests of clarity the duct work and fuel lines for supplying combustion air and fuel to each of the above-described burners are not shown in the accompanying figures.

The burner system operates to progressively heat the upper and lower portions of the slabs and thereafter the interior of the slabs as each line of slabs is advanced through the furnace step-by-step through successive pushing of additional slabs through the charging opening 50 into the preheat zone 20. As indicated earlier, however, the skid rails 60 shield part of the slab bottom surfaces from radiant heat and from direct contact with hot gases circulated by the burners, creating skid marks or lower temperature areas on the slab bottoms which correspond approximately to the areas in contact with the skid rails 60. To eliminate or minimize these skid marks, a lift rail assembly 100 is provided in the soak zone 24 to periodically raise the slabs out of contact with the skid rails in a manner which will now be described in detail.

Figure 2A:
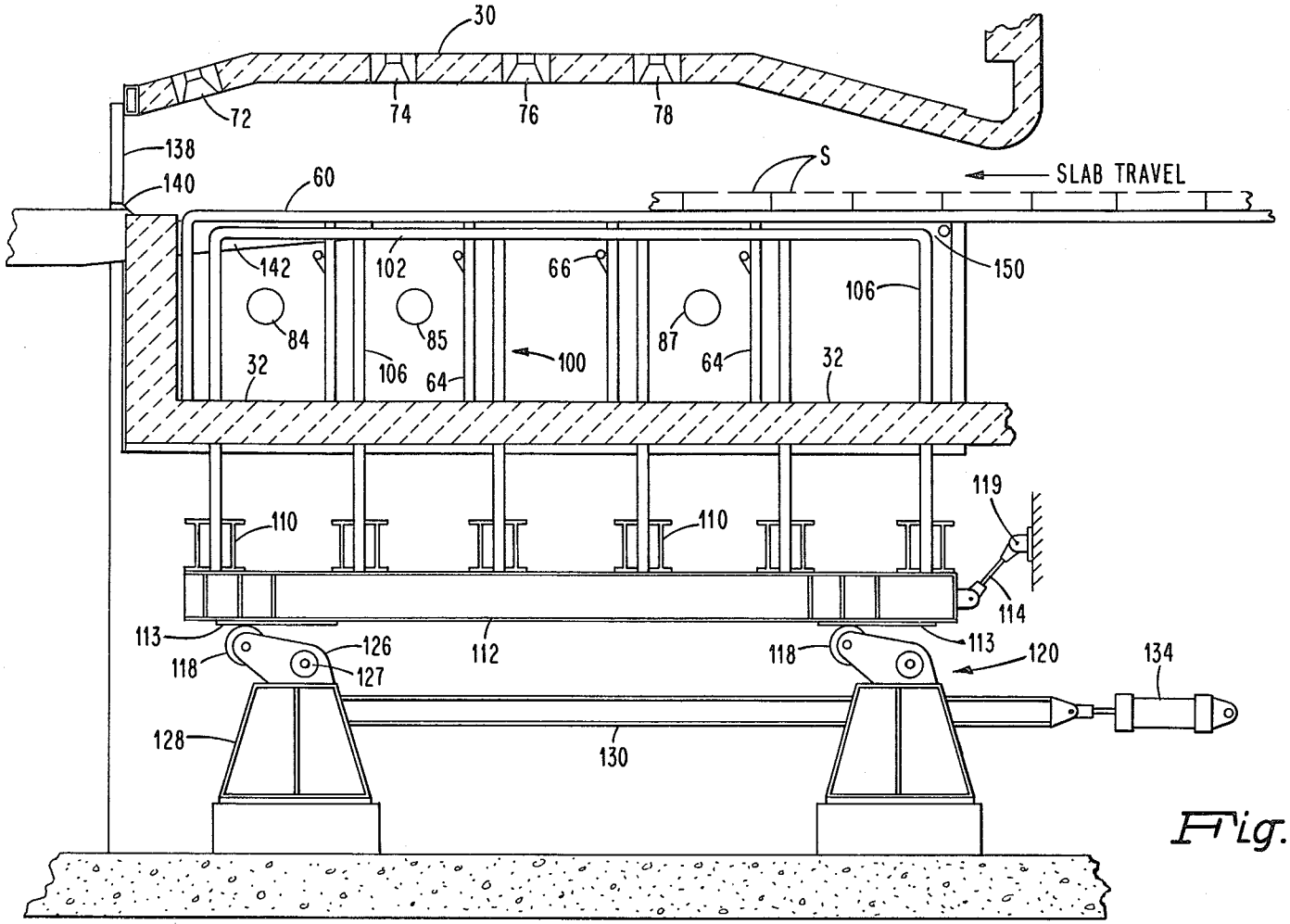
FIG. 2*a* is a longitudinal sectional view of the downstream end of a reheat furnace according to the invention illustrating the soak zone of the furnace with the lift rails in a lowered position.
Figure 2B:
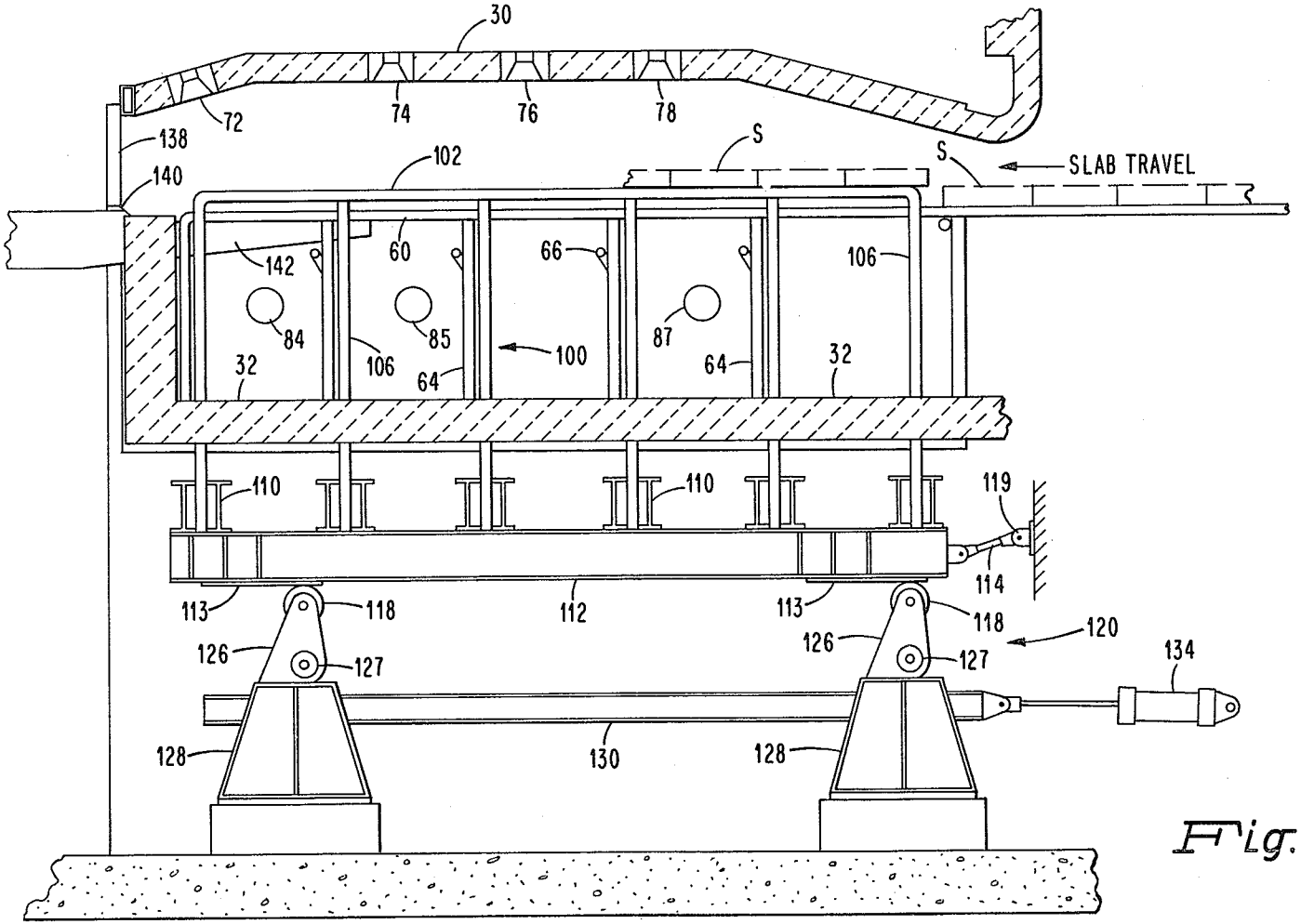
FIG. 2*b* is a longitudinal sectional view of the downstream end of a reheat furnace according to the invention illustrating the soak zone of the furnace with the lift rails in a raised position.
Figure 3:
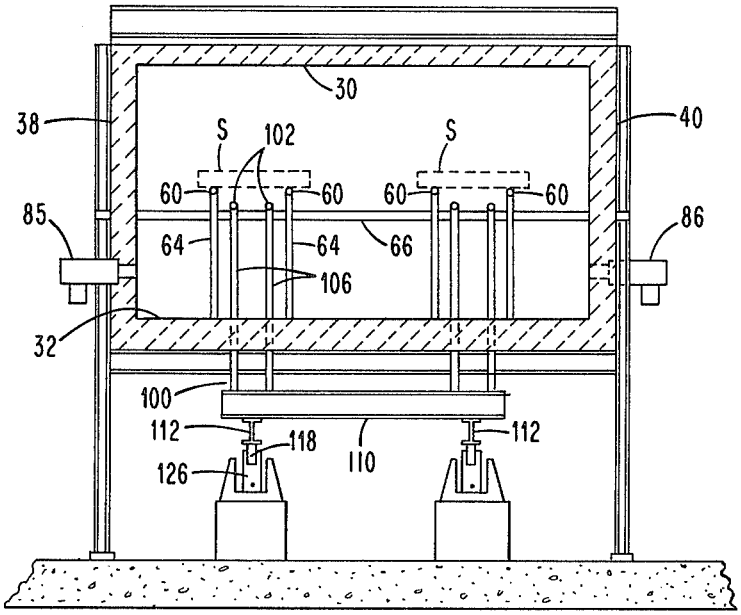
FIG. 3 is a cross-sectional view taken along line 3—3 of FIG. 1.
Figure 4:
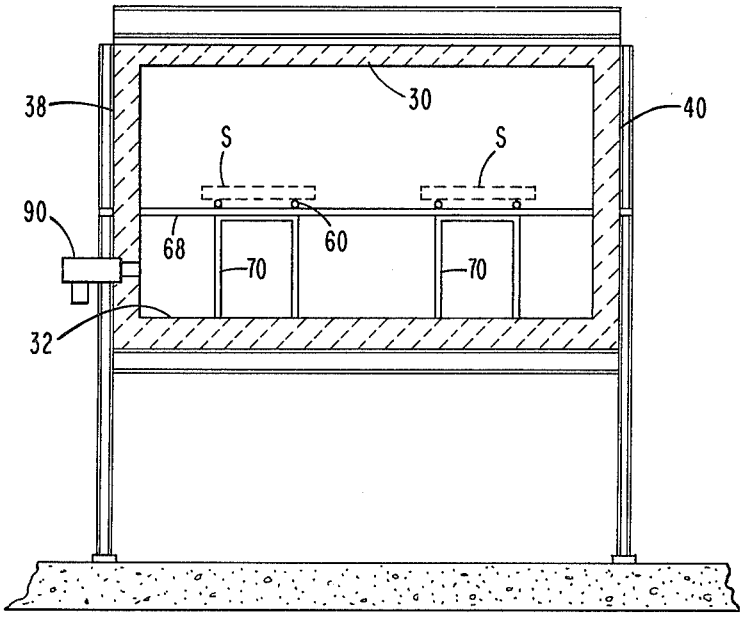
FIG. 4 is a cross-sectional view taken along line 4—4 of FIG. 1.

As is best seen in FIGS. 2 and 3, the lift assembly 100 comprises one or more sets of longitudinal lift rails 102 positioned generally parallel to, but laterally spaced from, the skid rails 60. The lift rails 102, like the skid rails 60, preferably include or are in contact with water-cooled piping of known design which in the interest of clarity has not been illustrated herein. The lift assembly illustrated as a preferred embodiment includes a pair of lift rails 102 between the rails 60 of each set of skid rails, an arrangement which facilitates handling of slabs having different sizes and also provides direct access of the hot gases and radiation to the skid mark areas when the slabs raised are in a position out of contact with the skid rails 60 (FIG. 2*b*). The lift assembly 100 also includes, beneath each lift rail 102, a plurality of vertical support members 106 which extend through the furnace hearth 32 and are attached to transverse beams 110 below the hearth. The beams 110 in turn are mounted on a pair of longitudinal lift beams 112 each of which includes one or more plates 113 on its underside on which ride rollers 118 of lift mechanisms 120. Attached to one end of each lift beam 112 is an anchor link 114 which is pinned at point 119 to permit pivoting of the link 114 about the point 119. Each roller 118 is attached to a crank arm 126 which is rotatably mounted on an axle 127 attached to a support base 128. The opposite end of each crank arm 126 is attached to a rod 130 which is operable to reciprocate in a back and forth motion (to the right and left as shown in FIGS. 1 and 2) in response to movement of a lift cylinder 134 connected to the rod 130. Translation of the rod 130 to the left from the position shown in FIG. 2*a* causes the crank arm 126 to rotate in a clockwise direction (as viewed in FIGS. 2*a* and 2*b*). The resulting arcuate movement of the rollers 118 as they roll along the surface of the plates 113 pushes the beams 112 and lift rails 102 upward, lifting the overlying slabs S up out of contact with the skid rails 60. Also, as the beams 112 move upward, the pivoting of the anchor link 114 about the point 119 pushes the beams 112 a short distance towards the discharge end of the furnace, causing the lift rails and the affected slabs to attain the positions shown in FIG. 2*b*. The horizontal movement of the lift assembly 100 towards the discharge end of the furnace during raising of the slabs separates the first slab raised from those behind it, which helps avoid interference and binding of adjacent slabs when the lift assembly is returned to its lowered position as shown in FIG. 2*a*. In general, a horizontal movement of about one to two inches should be sufficient to avoid binding, and a total amount of lift rail vertical movement of about six to nine inches will be adequate to lift the slabs out of contact with the skid rails 60 and to permit good transfer of heat to the skid mark areas of the raised slabs by radiation and, to a lesser degree, by convection.

The slabs S are held by the lift rails 102 in a raised position an amount of time which, when considered with the total number of "lifts" each slab will experience in passing through the soak zone 24, is sufficient to eliminate or minimize skid marks and bring the slabs to a uniform temperature. After passage of a suitable time interval, the lift cylinder 134 reverses the direction of translation of the rod 130, causing the lift rails 102 to return to their "lowered" position as shown in FIG. 2*a* and redepositing the slabs carried thereby to their position in contact only with the skid rails 60. Thereafter a discharge door 138 covering a discharge opening 140 in the discharge endwall of the furnace (but shown in the open position in FIGS. 2*a* and 2*b*) is opened to permit removal of a fully heated slab. An extractor 142 whose operation resembles that of a simple fork lift then reaches into the furnace, picks up and removes the last slab in line from the furnace 18, and directs it to the next processing stage such as a rolling mill. Following removal of a slab another slab is pushed into the furnace through the charge opening 50, thereby pushing each slab in the unbroken line of slabs one slab length along the skid rails 60. The lift mechanism 120 may then be reactivated to reduce skid marks on slabs in the soak zone 24.

To permit smooth progress of slabs or parts through the furnace and to achieve the desired uniform heating of the slabs, the pusher mechanism 54, the extractor 142, and the lift mechanism 120 are controlled either manually or by computer to operate in desired sequence relative to one another. Also, slab positions preferably are monitored at appropriate points such as at the upstream end 150 of the lift mechanism 120 to make certain that less than half the weight of any slab to be lifted extends upstream beyond the end 150. This ensures that slabs do not fall or slide off the lift rails 102.

To review, during operation of the furnace of the invention, slabs are pushed one at a time into the preheat zone 20 according to a desired sequence. Each slab loaded into the furnace pushes an adjacent slab one slab length along the skid rails 60 until at least one slab overlies the lift rails 102 in the soak zone 24. Thereafter between successive pushes, the lift rails 102 are raised to lift overlying slabs out of contact with the skid rails, thereby permitting hot gases circulated by burners such as the burners 84, 85, 86, and 87 to contact bottom slab areas previously shielded by the skid rails 60 and to eliminate or greatly reduce skid marks in those areas. The lift rails 102 are held in a raised position for a specified interval of time, then lowered to return the slabs to essentially their original position supported by the skid rails 60 of the soak zone 24 and ready for another push along the skid rails. When after a series of pushes, lifts, and lowerings, a slab nears the furnace discharge opening 140 and has been uniformly heated to the desired temperature, the next push of the line of slabs is preceded by removal of the slab through the opening 140 by the extractor 142. Thereafter, the sequence of pushing, lifting, lowering, and extracting slabs continues, producing a steady flow of heated slabs available for further processing.

In the event of a mill delay, loading of slabs into and removal of slabs from the furnace is halted and the soak zone lift rail assembly 100 continuously raises/lowers slabs in the soak zone 24 to distribute the time slabs in the soak zone are positioned on the lift rails 102 and on the skid rails 60 according to a schedule which yields uniform heating of the slabs. For example, the slabs may be supported by the lift rail assembly 75 percent of the time of each cycle during the delay, and supported 25 percent of the time by the skid rails. The cycling continues until the mill is ready to accept additional slabs from the furnace 18, and then normal furnace operation is resumed.

The furnace of the invention and particularly the combination of skid rails 60 and the lift assembly 100 of its soak zone, offers several advantages over pusher furnaces with soak hearths. In addition to avoiding the maintenance required of a soak hearth, the lift assembly 100 provides a simple, controllable, positive means for eliminating or reducing skid marks. Moreover, the invention permits significant fuel savings over conventional pusher furnaces operating at comparable production rates. These savings are primarily attributable to the nature of the soak zone 24 of the improved pusher furnace 18, and specifically its ability to function as a slab heating zone as well as a soak zone. The soak hearth in a conventional pusher furnace substantially precludes the use of burners mounted in the bottom portions of the soak zone thereof and therefore prevents any further significant heating of the bottom portions of the slabs beyond the "soaking" effect to reduce skid marks. By contrast, the open support arrangement provided by the lift assembly 100 and the skid rails 60 of the furnace 18 permits ready access of the combustion products of bottom-mounted burners such as the burners 84, 85, and 86 to the bottom surfaces of slabs therein. Additional heating of the bottom slab positions may be matched by further heating of the top portions, as by the burners 72, 74, 76, and 78 of the improved furnace 18. The effect of adding significant amounts of heat in the soak zone 24 is, for a specified slab outlet temperature, to permit more gradual heat input to the slab by use of lower burner firing rates and to permit more efficient use of fuel. Alternatively, and at some sacrifice in fuel savings, the furnace of the invention may be operated at production rates higher than those of prior art pusher furnaces by the use of somewhat higher burner firing rates.

Figure 5A:
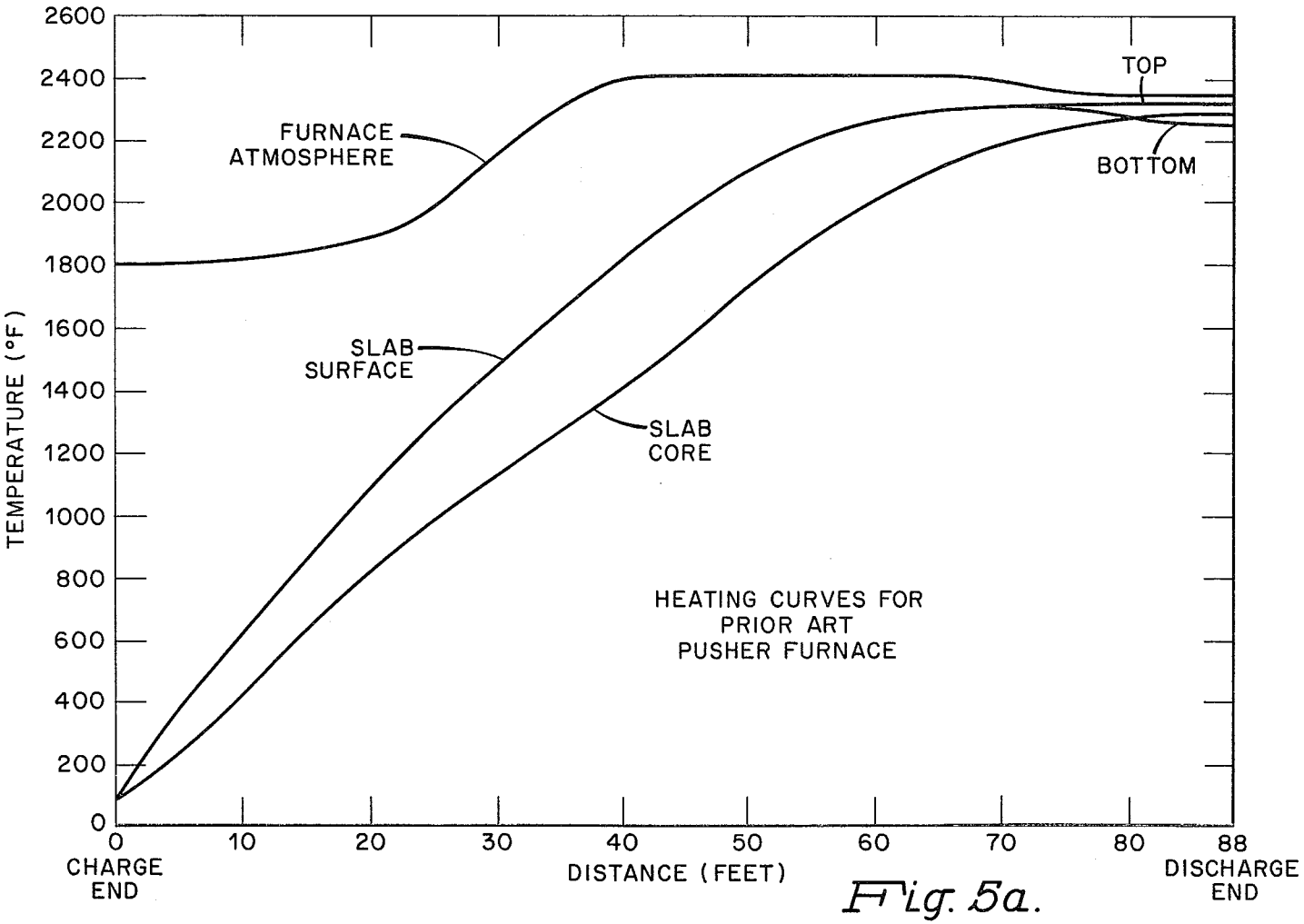
FIG. 5*a* is a graph showing heating profiles predicted for a prior art pusher-type furnace having a soak hearth.
Figure 5B:
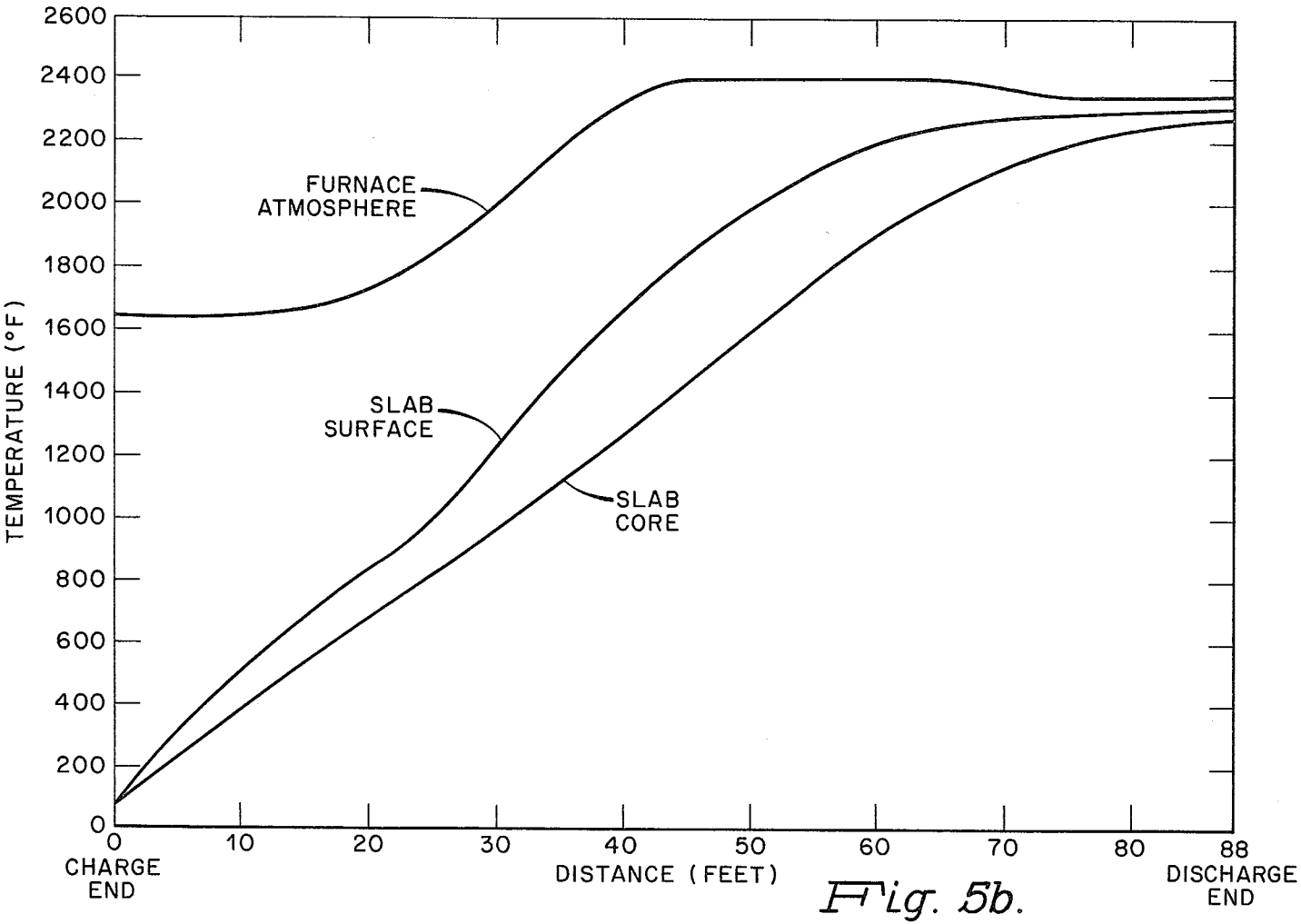
FIG. 5*b* is a graph showing heating profiles predicted for the furnace of the present invention operating at the same production rate as specified for FIG. 5*a*.
Figure 5C:
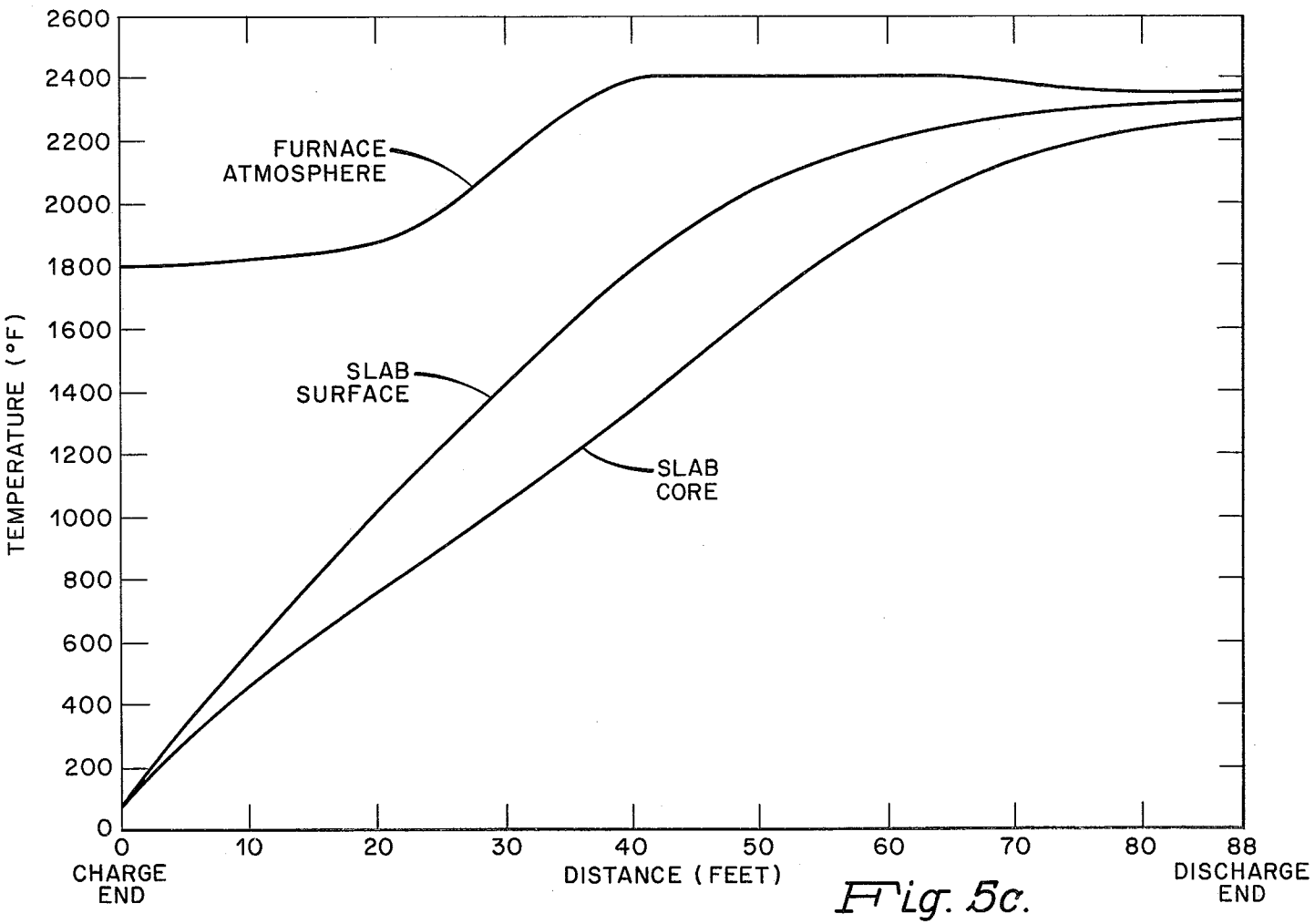
FIG. 5*c* is a graph showing heating profiles predicted for the furnace of the present invention operating with the same furnace atmosphere temperature profile as specified for FIG. 5*a*.

These benefits are illustrated in FIGS. 5*a*, 5*b*, and 5*c* which show predicted heating curves or plots of slab temperature versus location of the slab in a furnace. FIGS. 5*b* and 5*c* show heating curves for the improved furnace of the present invention, and FIG. 5*a* shows heating curves for a pusher-type furnace having a soak hearth and a length equal to that of the improved furnace. The heating curves include temperature profiles for the core or middle portion of a slab as well as for its top and bottom surfaces (not including skid rail effects) and also show the temperature profiles of the furnace atmosphere.

In the predicted runs steel slabs 8¼ inches thick by 22½ feet long were utilized. The slabs entered the furnaces at a temperature of about 70° F. and were discharged at a temperature of about 2300° F.

FIGS. 5*a* and 5*b* show that for a given production rate (139 tons per hour for the runs illustrated) the furnace of the present invention permits use of a lower furnace atomsphere temperature profile, particularly near its charge end. This reduces the temperature of exhaust gases leaving the furnace about 150° F., thus achieving, for an assumed burner inlet air temperature of 800° F., a net reduction in fuel consumption of about five percent compared to the prior art pusher furnace with soak hearth. Also, slab quality is improved, as is indicated by the reduced temperature differential in the slab at the discharge end of the furnace of the present invention. (The lower branch of the "slab surface" curve in FIG. 5*a* for the prior art furnace is the bottom surface temperature, whose lower values reflect cooling due to slab contact with a soak hearth.)

FIG. 5*c* shows heating curves which are predicted to result from operation of the improved furnace of the present invention with a furnace atmosphere temperature profile similar to that shown in FIG. 5*a*. With this temperature profile, an increase in production rate of about nine percent (to 152 tons per hour) can be achieved. A slight reduction in fuel efficiency occurs, however, because of the effect of the water-cooled piping utilized in the lift assembly 100. Slab heating quality, as determined by the maximum temperature difference between portions of the slab at the furnace discharge end, is still better for the furnace of the present invention than for the prior art pusher furnace operating at the lower rate of production.

While FIGS. 1–4 illustrate a preferred embodiment of the invention, it is apparent that the furnace may be embodied in other specific forms without departing from the spirit or essential characteristics of the invention. For example, although the skid rails 60 are illustrated in FIGS. 1–2 as comprising single, continuous rails extending along essentially the entire length of the furnace 18, each skid rail may instead comprise two portions which are offset from one other in order to help reduce slab skid marks. Each such skid rail includes a first portion extending through the preheat zone 20 and the heat zone 22, and a second portion in the soak zone 24 which is parallel to, but laterally offset from, the first portion. The first and second rail portions may be connected and preferably are closely spaced or overlap longitudinally so that slabs may slide readily from the first to the second rail portion as they are pushed into the soak zone 24. The lateral offset, which may be a few inches and preferably is equal to at least one rail width, assists in reducing the skid marks developed during travel of the slabs through the preheat zone 20 and the heat zone 22 by providing rail contact with a different part of the slab surface during slab travel through the soak zone 24. Although some additional skid marks will develop on the slab surface areas in contact with the second portion of the skid rails in the soak zone 24, such marks or lower temperature areas will be minimal because such areas enter the soak zone in a high temperature condition (i.e., with no skid marks), and the action of the lift assembly 100 will greatly reduce any skid marks which form in the soak zone.

FIG. 3 illustrates but one of several suitable arrangements of skid rails and lift rails, and other arrangements and relative numbers of rails may be utilized to ensure proper support of slabs of various sizes in the soak zone 24. For example, the lift rails may all lie outside of (rather than between) each pair of skid rails, or skid rails may alternate with lift rails across the width of the furnace.

As an alternative to the rod, crank arm, and roller assembly shown in FIGS. 1–3, the lift mechanism 120 may comprise hydraulic jacks or a roller/ramp arrangement similar to that set forth in U.S. Pat. No. 3,749,550. Also, the two lift mechanisms 120 illustrated in FIG. 3 hereof may be separtate and operable independently of one another rather than interconnected through the transverse beams 110.

Finally, other burner arrangements may be employed so long as the burners achieve the desired schedule of slab heating and do not interfere with operation of the lift mechanism. For example, the furnace may include one or more burners mounted in the furnace discharge endwall, in the upper portions of the side walls of the soak zone and heat zone, and/or in burner walls included in the soak or heat zones of the furnace.

The scope of the invention is indicated by the appended claims, and all changes which come within the meaning and range of equivalency of these claims are intended to be embraced therein.

What is claimed is:

1. In a furnace for heating metallic workpieces such as slabs, said furnace having a preheat zone, a heat zone, and a soak zone arranged in series between charging and discharging ends of the furnace, a pusher for pushing said workpieces in sequence into the furnace at said charging end for transport through the furnace and means for removing said workpieces from the furnace at said discharging end, the combination therewith comprising:

a fixed skid rail assembly including at least two parallel skid rails extending longitudinally along essentially the entire length of the furnace between said charging and discharging ends and arranged to support the workpieces during heating and transport of said articles through said furnace;

a lift rail assembly at least an upper portion of which is positioned in said soak zone, said lift rail assembly including at least two lift rails arranged essentially parallel to said skid rails, a plurality of upright support members having their upper ends attached to said lift rails, and a lift beam attached to the lower ends of said upright support member and extending generally parallel to said skid rails;

lift means for moving said lift rail assembly between a lowered position below and out of contact with the workpieces and a raised position wherein said lift rail assembly is operable to support workpieces in said soak zone a substantially uniform distance above said skid rail assembly; and means for supplying hot gases to the interior of said furnace to heat the workpieces.

2. A furnace according to claim 1 wherein said lift means includes at least one crank arm, a roller attached to the upper end of said crank arm and bearing against the underside of said lift beam, and means for rotating said crank arm about a pivot point to move said roller along the underside of said lift beam; and further including an anchor link having one end attached to said lift beam and an opposite end pivotable about a fixed point in a manner such that said lift rail assembly and any workpieces supported thereby are moved from an initial position upwards and a small distance toward the discharge end of said furnace upon raising of the lift rail assembly by said lift means, and are returned substantially to said initial position upon lowering of said lift rail assembly.

3. In a method for heating slabs in a reheat furnace including stepwise pushing of said slabs along skid rails through a preheat zone and a heat zone, and stepwise pushing of said slabs through a soak zone, the improvement comprising:

providing a skid rail assembly and a lift rail assembly extending longitudinally along said soak zone; and in cyclical fashion:

(a) pushing said slabs along said skid rail assembly;

(b) raising said slabs on said lift rail assembly a substantially uniform distance above said skid rail assembly to permit reduction of skid marks on the bottom portions of said slabs;

(c) lowering said slabs to reposition them on said skid rail assembly in substantially their original position prior to said raising step; and (d) extracting a slab from the discharge end of said soak zone.

4. A method for heating slabs according to claim 3 wherein said raising step includes, in addition to a vertical component of motion, a horizontal component towards the discharge end of said soak zone to avoid interference and binding of adjacent slabs, said horizontal component being considerably smaller than said vertical component.

* * * * *